United States Patent [19]

Edlund

[11] Patent Number: 5,072,484

[45] Date of Patent: Dec. 17, 1991

[54] VACCUM CLEANER SUCTION CONTROL

[75] Inventor: Leif E. Edlund, Upsala, Sweden

[73] Assignee: Aktiebolaget Electrolux, Stockholm, Sweden

[21] Appl. No.: 582,946

[22] PCT Filed: Jan. 24, 1990

[86] PCT No.: PCT/SE90/00049

§ 371 Date: Oct. 11, 1990

§ 102(e) Date: Oct. 11, 1990

[87] PCT Pub. No.: WO90/09138

PCT Pub. Date: Aug. 23, 1990

[30] Foreign Application Priority Data

Feb. 14, 1989 [SE] Sweden ..... 8900503

[51] Int. Cl.[5] ..... A47L 9/28

[52] U.S. Cl. ..... 15/319; 15/339

[58] Field of Search ..... 15/319, 339

[56] References Cited

U.S. PATENT DOCUMENTS 4,920,607 5/1990 Köhn ..... 15/339

4,969,229 11/1990 Suanberg et al. ..... 15/339

*Primary Examiner*—Chris K. Moore

*Attorney, Agent, or Firm*—Pearne, Gordon, McCoy & Granger

[57] ABSTRACT

A vacuum cleaner has an electric motor (15) and a suction fan (17) connected to the motor. A control device (16) drives the motor in a speed range limited upwards by a rated voltage corresponding to a rated power level for the motor. Circuit components (46, 39; 30, 31) are provided after actuation of a manually operable switch (19), to temporarily connect the motor (15) to a voltage exceeding said rated voltage, resulting in operation at an increased power level during a predetermined time. The circit components (46, 39; 30 31) for connecting of the increased voltage includes a thermally-operated device (46, 30) which cooperates with the control device (16) for the connection and disconnection, respectively, of the increased voltage, the predetermined time being determined by the heating time for the thermally-operated device.

10 Claims, 2 Drawing Sheets

VACCUM CLEANER SUCTION CONTROL

BACKGROUND OF THE INVENTION

The present invention relates generally to suction control devices for vacuum cleaners and, more specifically, to a booster control device to operate the fan motor of a vacuum cleaner at an elevated rate for a predetermined period of time.

From WO-87/01921 a vacuum cleaner is known which is provided with a suction fan driven by an electric motor. The vacuum cleaner is supplied from the mains and is provided with an electronic speed control device by which the suction force of the vacuum cleaner can be set. By actuation of an operating member the vacuum cleaner can be driven at an increased power level, which exceeds the rated maximum power level, during a predetermined time period after which the vacuum cleaner motor is operated to return to its normal power range. In addition, means are provided for preventing the renewed operation in the region not allowed before the lapse of a predetermined time.

SUMMARY OF THE INVENTION

The device described in the publication, usually referred to as a "booster", has a design which is relatively complicated comprising quite a number of electronic components. Therefore, one object of the invention is to provide a booster device performing the same function but having a simpler design.

In addition, the booster device described in the publication presupposes the vacuum cleaner to be operated from the mains. Nowadays, battery operated vacuum cleaners are also being manufactured too and it is a further object of the invention to provide a booster device which can be used also in such application.

BRIEF DESCRIPTION OF THE DRAWINGS

The invention will now be described more in detail in connection with two embodiments relating to a mains operated vacuum cleaner and to a battery operated vacuum cleaner, respectively. The description is made with reference to the enclosed drawings, in which.

DETAILED DESCRIPTION OF THE PREFERRED EMBODIMENTS

Figure 1:
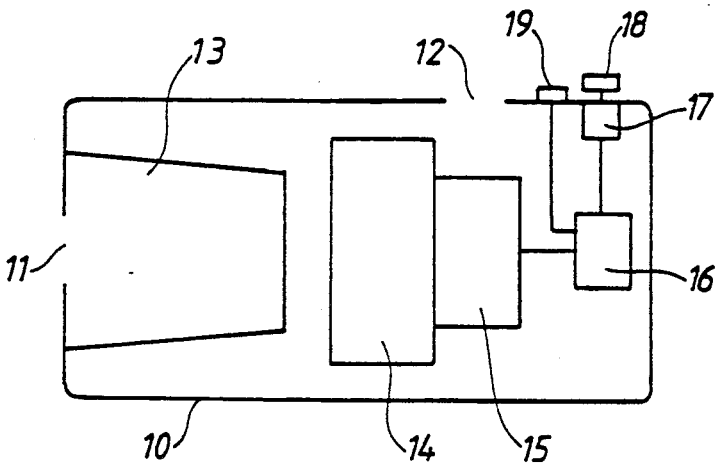
FIG. 1, schematically, shows a vacuum cleaner.

FIG. 1 shows, schematically, the construction of a vacuum cleaner. In a housing 10 there are provided an inlet opening 11 and an outlet opening 12. By a suction fan 14, driven by an electric motor 15, an air stream is created between the inlet and outlet openings via a dust container 13. An electronic speed control device 16 is provided by which the suction force can be set for different operating modes. The setting takes place by means of a potentiometer 17 operated by a knob 18. For the switching-in of an extra high suction force, the booster position, a push-button 19 is provided, by means of which the control device is operated.

Figure 2:
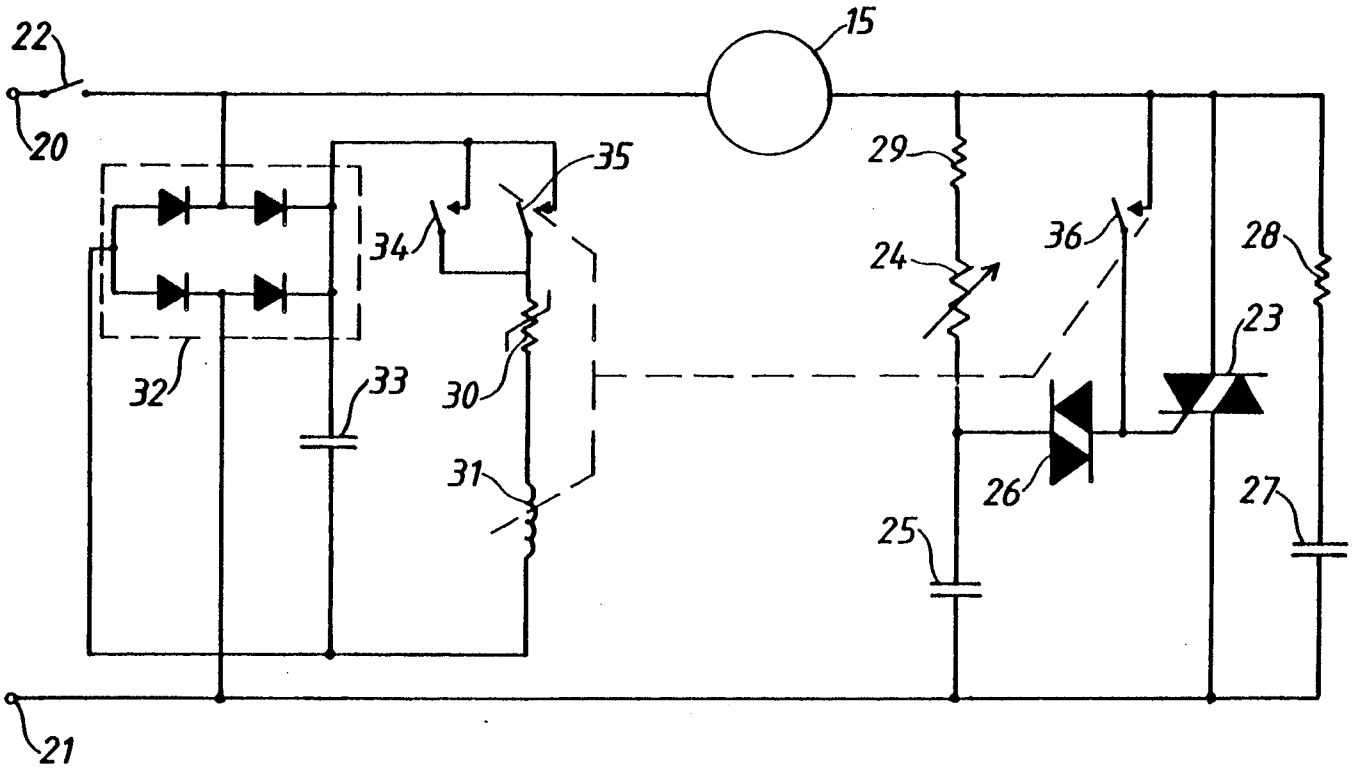
FIG. 2 is a circuit diagram for a booster device in connection with a mains operated vacuum cleaner.

FIG. 2 shows a circuit diagram for a mains operated vacuum cleaner provided with a booster device according to the invention. The motor, which is a common series motor, is connectable, via terminals 20,21 and a switch 22, to an AC mains, for example for 220 volts.

The motor is connected in series with a triac 23 which, in the usual way, is provided with a trigger device comprising a resistor 29, a potentiometer 24, a capacitor 25 and a diac 26. The potentiometer, the resistor and the capacitor form a series circuit which is connected in parallel with the triac 22. The connecting point between the potentiometer and the capacitor is connected, via the diac 26, to the control electrode of the triac 23. A series circuit, formed by a capacitor 27 and a resistor 28, is connected in parallel across the triac, protecting it against transients. By means of the potentiometer 24 the desired trigger angle for the triac 22 can be chosen and by that the speed and the suction force can be varied. The component values of the resistor 29, the potentiometer 24 and the capacitor 25 have been chosen so that the triac is not conducting through the whole of each half period even at the maximal suction force, set by the potentiometer. This means that the maximal mean voltage of the motor is lower than the mains voltage.

In order to provide the additional suction force the vacuum cleaner is to be operated in the booster mode, here meaning that the triac is conducting through the maximal dwell angle, causing the mean voltage mainly to equal the mains voltage. The motor is rated to the maximum mean voltage, set by the potentiometer 24, and must not operate at mains voltage level longer than for a short period of 10–20 seconds. In order to provide for the booster mode, referred to, a special circuit arrangement is included comprising a PTC-resistor 30 in series with a relay 31. This series circuit is supplied with current from the mains via a rectifier 32, a smoothing capacitor 33 and a spring-back contact 34, operated by the push-button 19 (FIG. 1). Via a relay contact 35, connected in parallel with the contact 34, self energising current is supplied to the relay. A further relay contact 36 is connected in parallel to the series circuit consisting of the diac 26 and the potentiometer 24.

The circuit of FIG. 2 functions in the following way. The mains voltage is applied by closing of switch 22. By setting of the potentiometer 24, the suitable speed for the motor is chosen and thereby the desired suction force with regard to the nature of the surface to be vacuumed. If there is a desire for extra high power from the vacuum cleaner, the contact 34 is closed causing current to flow through the winding of the relay 31. The relay becomes energised closing the hold contact 35 by which the relay is supplied with current even after the return of the contact 34 to the position shown in FIG. 2. The relay closes the contact 36 too, disconnecting the trigger device, comprising the potentiometer 24, the capacitor 25 and the diac 26. Now, the trigger device receives trigger pulses directly from the mains voltage, for each half period meaning that the triac will be triggered already when the voltage between the control electrode and the terminal 21 amounts to 1 volt or so, 3 volts at the most, positively or negatively. Therefore, one could say that the mean voltage (RMS) supplied to the motor mainly equals the mains voltage. Accordingly, the said voltage exceeds the rated supply voltage of the motor, determined by the trigger device 24–26. For that reason, as mentioned above, the motor must not operate in the booster mode longer than for a short time of 10–20 seconds, after which the motor have to return to a speed within a speed range which, at a maximum, results in the rated motor output.

The limit of time for the booster mode is determined by the PTC-resistor 30 which when heated to a sufficient extent changes its resistance abruptly from a low to a high value, causing the current through the relay to drop below the hold value. The relay turns-off, the contacts 35 and 36 open and the motor speed is again determined by the trigger circuit described.

Figure 3:
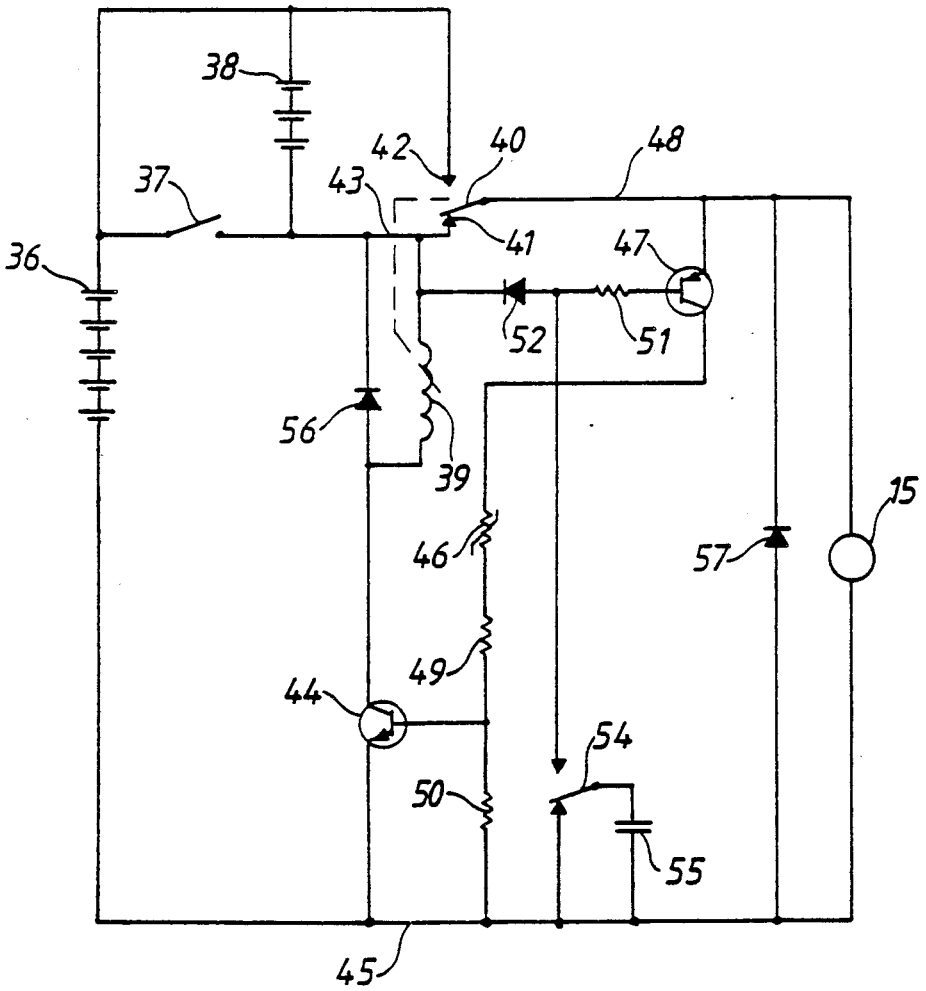
FIG. 3 is a circuit diagram for a booster device in connection with a battery operated vacuum cleaner.

An embodiment in connection with a battery operated vacuum cleaner is shown in FIG. 3. The vacuum cleaner motor 15 is driven from a lead accumulator 36, for 12 volts, via a switch 37. For operation in the booster mode an additional battery 38 is provided, being a rechargeable battery of the NiCd-type. This battery can be connected in series with the battery 36 to provide a higher supply voltage for the motor, thereby increasing its speed and its suction force. In order to connect the batteries in series a relay 39 is used which has a change-over contact 40. When the relay is inactivated the contact 40 bears on a contact 41, thereby connecting the motor 15 to the positive terminal of the battery 36. When the relay is energised, the contact 40 bears on a contact 42 which is connected to the positive terminal of the battery 38. The negative terminal of the battery is connected to a conductor 43 which is, via switch 37, connected to the positive terminal of the battery 36.

Via a transistor 44, the relay 39 is connected to a conductor 45, being a common current return conductor in the circuit diagram. Via a transistor 47, a PTC-resistor 46 is connected to a conductor 48 connected to the contact 40. In addition, via two resistors 49,50, the PTC-resistor is connected to the conductor 45. The resistors form a voltage divider and the connecting point between the resistors is connected to the control electrode (the base) of the transistor 44. The control electrode (the base) of the transistor 47 is connected, via a resistor 51 and a diode 52, to the conductor 43. Via a spring-returned, manually operated contact 54 the connecting point between the diode 52 and the resistor 51 is connectable to a capacitor 55, the opposite end of which is connected to the conductor 45. In order to prevent transients, a diode 56 is connected in parallel to the relay 39. For the same purpose a diode 57 is connected in parallel to the motor 15.

The arrangement shown in FIG. 3 functions in the following way. Upon closing of the switch 37 current flows in the battery circuit via the conductor 43, the contacts 41,40, the conductor 48, the motor 15 and the conductor 45. As a result, the motor rotates at a speed determined by the voltage of the battery 36. Now, if it is desired to operate the motor in the booster mode at increased voltage, contact 54 is actuated connecting the capacitor 55 into the control circuit of transistor 47. The transistor is brought into its conductive state and a current will flow in the control circuit of transistor 44. Also this transistor is forced to conduct and a current will flow through the winding of relay 39 causing the relay to become energised so that the contact 40 is operated to engage the contact 42. Thereby, via the conductors 48 and 45, the battery 38 in series with the battery 36 will be connected to the motor which will be driven at an increased speed determined by the added voltages from the batteries 36 and 38.

Via the current consisting of the diode 52 and the resistor 51 the base of the transistor 47 is given a potential keeping the transistor conducting even after the return of the contact 54 to the position shown in the figure. Therefore, a current will continue to flow in the control circuit of the transistor 44 and through the PTC-resistor 46. The resistor is heated and after the lapse of 10 to 20 seconds a temperature has been reached at which the resistance is abruptly changed from a low to a high value. This causes the transistor 44 to be cut-off so that the current through the relay winding ceases to flow and the relay turns off. The contact 40 changes over to engage the contact 41 and the initial condition has been reestablished.

The circuits described above may be modified for use of NTC-resistors instead of PTC-resistors.

I claim:

1. Arrangement for a vacuum cleaner provided with an electric motor (15) and a suction fan (14) connected to said motor, comprising a control device (15) provided to have the motor operate in a speed range which is limited upwards by a rated voltage corresponding to a rated power level for the motor, manually operable means (19) for activating coupling means (46,39;30,31) provided to temporarily connect the motor (15) to a voltage exceeding said rated voltage resulting in operation of the motor at an increased power level during a predetermined time, said coupling means including a thermally-operated means (46;30) for determining of said predetermined time, and means for heating said thermally-operated means initiated by operation of said manually operated means, said thermally operated means allowing operation of said coupling means when heated less than said predetermined time, and prohibiting operation of said coupling means after having been heated for said predetermined time.

2. An arrangement according to claim 1, wherein the means (46.39;30,31) for connecting of the increased voltage comprises a relay (31) connected in series with the thermally-operated means (30), said thermally-operated means when not heated for the predetermined time permitting current supply to the relay (31) but when heated for the predetermined time limits the current to a level below the hold current of the relay.

3. An arrangement according to claim 2, wherein the thermally-operated means (46;30) is a PTC-resistor.

4. An arrangement according to claim 3, wherein the vacuum cleaner is to be connected to the mains, characterized in that the motor (15) is connected in series with an electronic switch in the form of a triac (23) with a trigger device (24,25,26) of a design such that the mean voltage (RMS) supplied to the motor is lower than the mains voltage, the relay (31) having a contact (36) which when the relay is energized operates the trigger device (24,25,26) so as to have the mean voltage mainly equal to the mains voltage.

5. An arrangement according to claim 4, wherein the relay (31) and the PTC-resistor (30) are supplied with current via a hold contact (35) on the relay, said manually operated means included a spring-returned, manually operated contact (34) being connected in parallel to the hold contact (35).

6. An arrangement according to claim 5, wherein the trigger device comprises a potentiometer (24) and a capacitor (25) forming a series circuit connected in parallel to the triac switch (23), the connecting point between the potentiometer (24) and the capacitor (25), via a diac (26), being connected to the control electrode of the switch (23), said relay (31) having a contact (36) which, when the relay is energised, connects the control electrode to the terminal on the switch (23) connected to the motor (15).

7. An arrangement according to claim 1, wherein the vacuum cleaner is battery-operated and for normal operation connected to a first battery (36) and for operation at an increased power level is connected to a series circuit comprising the first battery (36) and a second battery (38), characterized in that the thermally-operated means (46) is disposed in the control circuit of a first transistor (44) which, in series with a relay (39), is connected to the first battery and, via a change-over contact (40), operated by the relay (39), is connected to the motor, wherein in the non-energised state of the relay the change-over contact (40) connecting the motor to the first battery (36) while in the energised state of the relay said contact (40) connects the motor to a series circuit comprising the first and second batteries (36,38).

8. An arrangement according to claim 7, wherein the control circuit of the first transistor (44), via the collector-emitter path of a second transistor (47), is connected in parallel to the motor (15), said manually operated means including a spring-returned, manually operable contact (54) being provided, said contact when closed activating the second transistor (47) which, in turn, energises the relay (39).

9. An arrangement according to claim 8, wherein means (52) are provided to connect the control circuit of the second transistor (47) to the first battery (36) so that when the relay (39) is energised the second transistor (47) remains conducting even after the inactivation of the spring-returned contact (54) in the control circuit of the said transistor.

10. An arrangement according to claim 9, wherein, via a diode (52), the control circuit of the second transistor (47) is connected to the positive terminal of the first battery (36), the direction of current flow of the diode being towards said positive terminal.

* * * * *